US006702685B2

(12) United States Patent
Mahlstedt et al.

(10) Patent No.: US 6,702,685 B2
(45) Date of Patent: Mar. 9, 2004

(54) COLLAPSIBLE SWING AND METHOD OF USING THE SAME

(75) Inventors: Curt J. Mahlstedt, Orchard Park, NY (US); Robert J Sonner, South Wales, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/133,630

(22) Filed: Apr. 29, 2002

(65) Prior Publication Data

US 2003/0203761 A1 Oct. 30, 2003

(51) Int. Cl.[7] ..... A63G 9/12
(52) U.S. Cl. ..... 472/118; 472/119
(58) Field of Search ..... 472/118, 119, 472/120, 121, 122, 123, 124, 125; 297/273

(56) References Cited

U.S. PATENT DOCUMENTS

| | | | | |
|---|---|---|---|---|
| 234,311 | A | 11/1880 | Marshall | |
| 433,649 | A | 8/1890 | Elias | |
| 955,841 | A | 4/1910 | Benner | |
| 2,076,675 | A | 4/1937 | Sharp | |
| 2,398,384 | A | 4/1946 | Meyers | |
| 2,638,966 | A | 5/1953 | Wardlaw | |
| 2,708,960 | A | 5/1955 | Shepard | |
| 2,972,152 | A | 2/1961 | Vincent | |
| 2,988,136 | A | 3/1961 | Kowalczyk | |
| 3,004,793 | A | 10/1961 | Loomis | |
| 3,256,016 | A | 6/1966 | Berlin | |
| 4,211,401 | A | 7/1980 | Cunard | |
| 4,377,011 | A | 3/1983 | Kinberger | |
| 4,424,760 | A * | 1/1984 | Grufman | 114/363 |
| 4,693,512 | A | 9/1987 | Hobson | |
| 4,822,033 | A | 4/1989 | Kohus et al. | |
| 4,948,120 | A | 8/1990 | Krueger et al. | |
| 5,154,672 | A | 10/1992 | Brown | |
| 5,269,587 | A | 12/1993 | Cunningham et al. | |
| 5,326,327 | A | 7/1994 | Stephens et al. | |
| 5,378,196 | A | 1/1995 | Pinch et al. | |
| 5,451,095 | A | 9/1995 | Riback | |
| 5,525,113 | A | 6/1996 | Mitchell et al. | |
| 5,533,936 | A | 7/1996 | Julien et al. | |
| 5,562,548 | A | 10/1996 | Pinch et al. | |
| 5,617,594 | A | 4/1997 | Chien | |
| 5,708,994 | A | 1/1998 | Chandran | |
| 5,769,727 | A | 6/1998 | Fair et al. | |
| 5,833,545 | A | 11/1998 | Pinch et al. | |
| 5,846,136 | A | 12/1998 | Wu | |
| 5,887,945 | A | 3/1999 | Sedlack | |
| 5,975,631 | A | 11/1999 | Fair et al. | |
| 5,984,791 | A | 11/1999 | Fair et al. | |
| 6,059,667 | A | 5/2000 | Pinch | |
| 6,251,023 | B1 | 6/2001 | Lauro et al. | |
| 6,319,138 | B1 * | 11/2001 | Fair et al. | 472/119 |
| 6,520,862 | B1 | 2/2003 | Armbruster et al. | |

FOREIGN PATENT DOCUMENTS

| | | |
|---|---|---|
| DE | 1 429 277 | 1/1969 |
| DE | 33 34 229 A1 | 4/1985 |
| GB | 137956 | 1/1920 |

* cited by examiner

*Primary Examiner*—Kien T. Nguyen
(74) *Attorney, Agent, or Firm*—Cooley Godward LLP

(57) ABSTRACT

An infant swing that may be used to pacify and/or entertain an infant is disclosed. In one embodiment, the swing includes a collapsible seat frame and a collapsible base frame. In another embodiment, the swing includes curved hanger arms that support a seat.

27 Claims, 7 Drawing Sheets

COLLAPSIBLE SWING AND METHOD OF USING THE SAME

BACKGROUND OF THE INVENTION

This invention relates generally to infant swings, and in particular, to a collapsible swing that may be used to entertain and/or pacify an infant located in the swing.

Conventional infant swings may be used to pacify and relax infants. Some conventional swings are design to be folded or otherwise collapsed for transportation and storage. However, even in their collapsed configurations, such swings may be difficult to transport and/or store due to their size and shape. Many conventional swings are difficult to transport because they lack any structure that permits a parent or caregiver to easily grasp and carry the swing.

A need exists for an infant swing that is easily disposable in a deployed configuration and in a collapsed configuration. Moreover, a need exists for an infant swing that can be easily transported.

SUMMARY OF THE INVENTION

The present invention relates to an infant swing that may be used to pacify and/or entertain an infant. In one embodiment, the swing includes a collapsible seat frame and a collapsible base frame. In another embodiment, the swing includes curved hanger arms that support a seat. The hanger arms are supported on the base frame and are oriented so that they are open or concave towards the rear of the swing. In another embodiment, a base frame of the swing includes housings that have handles to facilitate the transportation of the swing.

DETAILED DESCRIPTION OF THE INVENTION

The present invention relates to an infant swing that may be used to pacify and/or entertain an infant. In one embodiment, the swing includes a collapsible seat frame and a collapsible base frame. In another embodiment, the swing includes curved hanger arms that support a seat. The hanger arms are supported on the base frame and are oriented so that they are open or concave towards the rear of the swing. In another embodiment, a base frame of the swing includes housings that have handles to facilitate the transportation of the swing.

Figure 1:
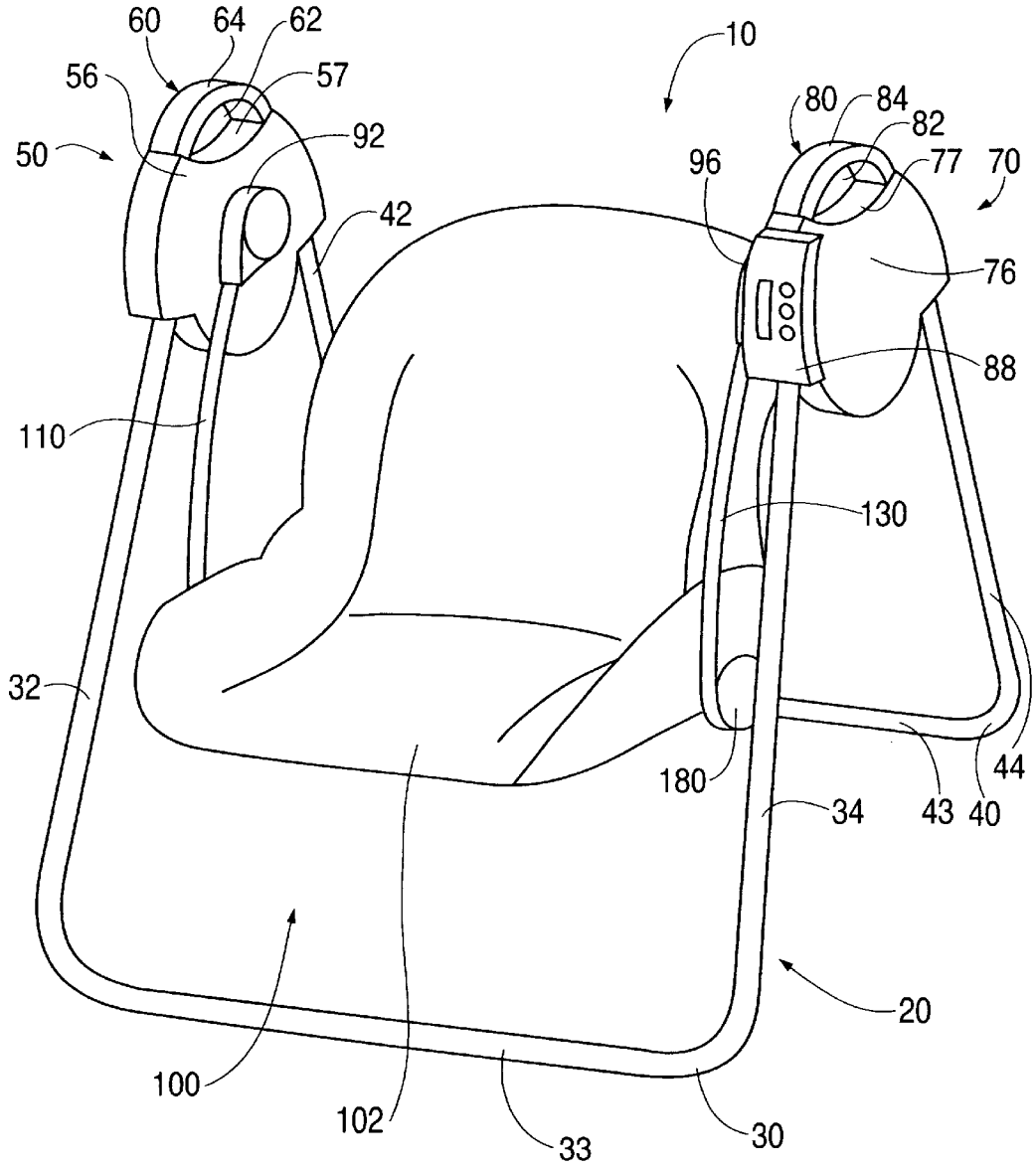
FIG. 1 illustrates a perspective view of an embodiment of a swing according to the present invention.

An embodiment of a swing according to the present invention is illustrated in FIG. 1. In the illustrated embodiment, the swing 10 includes a base frame 20 and a seat assembly 100 coupled to the base frame 20.

The base frame 20 includes a front frame portion 30 and a rear frame portion 40. As illustrated in FIG. 1, the front frame portion 30 includes a substantially U-shaped member with front legs 32 and 34 and a ground engaging portion 33 coupled to the lower end of each of the front legs 32 and 34. The front legs 32 and 34 include upper ends 36 and 38, respectively (see FIG. 2).

Similarly, the rear frame portion 40 includes a substantially U-shaped member with rear legs 42 and 44 and a ground engaging portion 43 coupled to the lower end of each of the rear legs 42 and 44. The rear legs 42 and 44 include upper ends 46 and 48, respectively.

In the illustrated embodiment, the base frame 20 includes housings 50 and 70. The upper end 36 of front leg 32 and the upper end 46 of rear leg 42 are pivotally coupled to housing 50. Similarly, the upper end 38 of front leg 34 and the upper end 48 of rear leg 44 are pivotally coupled to housing 70. The front legs and rear legs are coupled to the housings 50 and 70 using any conventional connector or fastener, such as snap tabs, rivets, and/or pins.

The seat assembly 100 is supported by the base frame 20 for movement. The seat assembly 100 includes a seat frame 104 (see FIG. 2). The seat frame 104 includes a rear backrest portion 105A and a front seat portion 105B. The seat frame 104 also includes a fabric material 102 disposed on the seat frame 104. The fabric material 102 is preferably a unitary piece of fabric including pockets which allow it to be removably mounted on the seat frame 104.

In the illustrated embodiment, the swing 10 includes a conventional friction drive mechanism (not shown) in housing 70. The swing 10 also includes a hub 92 coupled to housing 50 and a hub 96 coupled to housing 70. The hubs can be coupled to the housings in many different ways. In the illustrated embodiment, hub 92 is mounted on a pivot formed on the housing 50 and the hub 96 is mounted on an element of the drive mechanism extending from housing 70. In alternative embodiments, a portion of a hub can be mounted into an opening in a housing or the hub can be mounted on a structure proximate to the opening or a pivot point on the housing.

Figure 2:
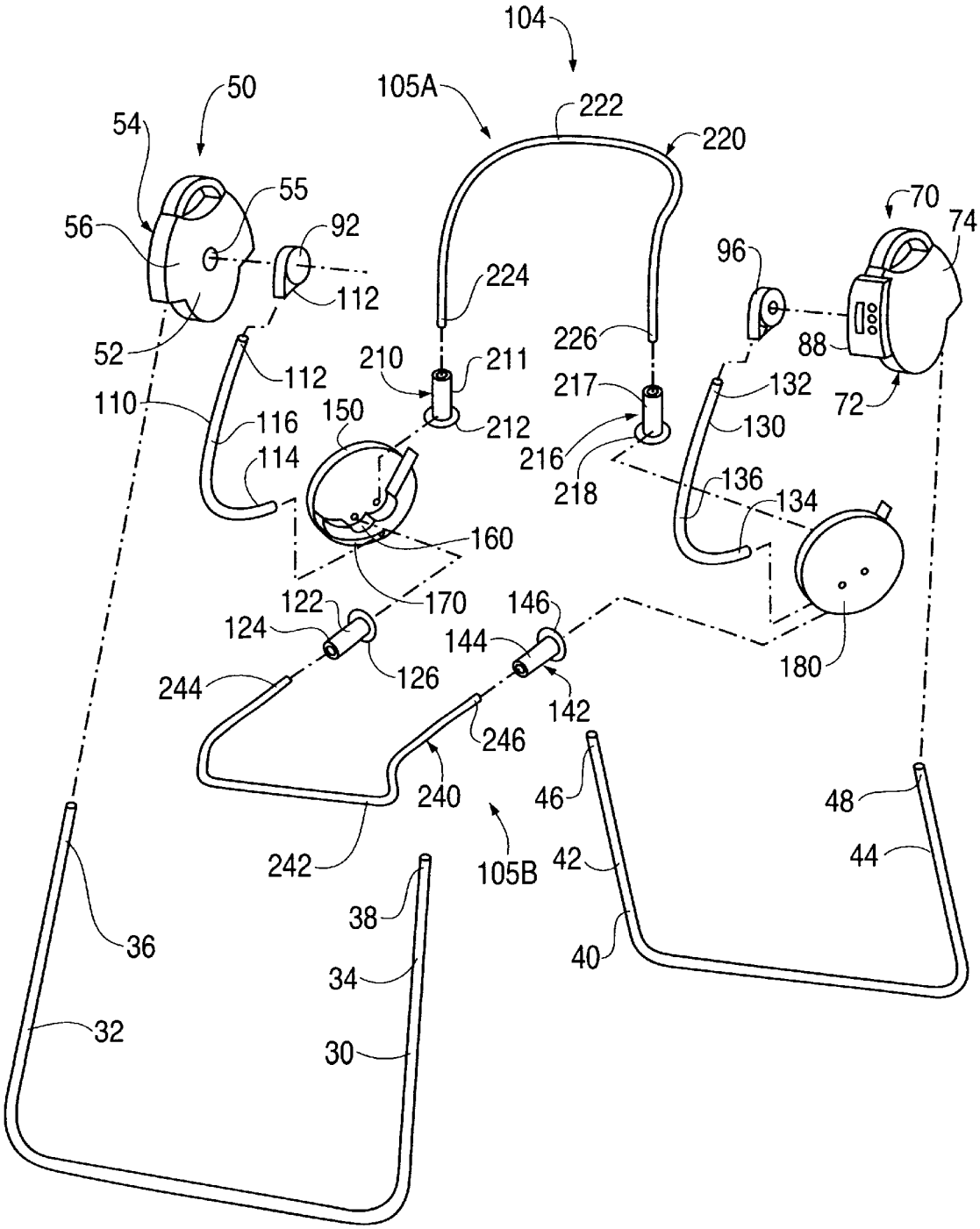
FIG. 2 illustrates an exploded perspective view of the swing of FIG. 1.

The seat frame 104 includes a support or hanger arm 110 coupled to hub 92 and a support or hanger arm 130 coupled to hub 96. Hub 96 is operatively coupled to the drive mechanism and when the drive mechanism operates, reciprocating motion is imparted to hub 96 and hanger arm 130. Hub 92 is mounted on a pivot 55 located on the inner side 52 of housing 50 as illustrated in FIG. 2. As the hub 96 is driven by the drive mechanism, the seat assembly 100 moves and hub 92 reciprocates back and forth on the pivot 55.

In the illustrated embodiment, housing 50 includes a body 56 and a handle portion 60. The body 56 includes an inner side 52 and an outer side 54. The handle portion 60 includes a handle 64 located proximate to and extending from the upper surface 57 of the body 56. The handle 64 and the upper surface 57 of the body 56 define a handle or transport opening 62 therebetween. The opening 62 is configured to allow a parent or caregiver to insert a hand or other structure through the opening 62 and grip the handle 64 to transport the swing 10.

The housing 70 includes a body 76 and a handle portion 80. The body 76 includes an inner side 72 and an outer side 74. The handle portion 80 of housing 70 includes a handle 84 located proximate to and extending from the upper surface 77 of the body 76. The handle 84 and the body 76 define a handle or transport opening 82 therebetween. Similar to opening 62, opening 82 is configured to allow a parent or caregiver to grip the handle 84 to transport the swing 10.

The handles 64 and 84 may have any configuration and/or size that a user to grip the handles 64 and 84 and transport the swing 10. In the illustrated embodiment, the handles 64 and 84 are integrally formed with the bodies 56 and 76 of housings 50 and 70, respectively. In an alternative embodiment, the handles may be separate elements and coupled to the corresponding housing body using any conventional mechanism or technique, such as a fastener or an adhesive.

In the illustrated embodiment, the housing 70 also includes control panel 88 mounted along an outer surface of the housing 70. The control panel 88 includes a switch assembly (not shown) that enables the parent or caregiver to turn on the drive mechanism for the swing and select a particular swing amplitude. The location and function of the control panel may vary depending on the desired motion and control of the swing.

Referring to FIG. 2, an exploded perspective view an embodiment of the swing 10 is shown. Hanger arm 110 includes a body portion 116 and ends 112 and 114. Similarly, hanger arm 130 includes a body portion 136 and ends 132 and 134. In the illustrated embodiment, the body portions 116 and 136 are non-linear. For example, the body portions 116 and 136 may be curved or may have a J-shape configuration or any other shape or configuration that is not completely in a straight line.

In the illustrated embodiment, the seat frame 104 includes two side connectors 150 and 180 coupled to hanger arms 110 and 130, respectively. The upper end 112 of hanger arm 110 is coupled to hub 92 and the lower end 114 of hanger arm 110 is coupled to side connector 150. Similarly, the upper end 132 of hanger arm 130 is coupled to hub 96 and the lower end 134 of hanger arm 130 is coupled to side connector 180.

The seat frame 104 also includes a back or upper frame member 220 and a leg or lower frame member 240. Back frame member 220 is pivotally coupled to connectors 150 and 180. Leg frame member 240 is also pivotally coupled to connectors 150 and 180.

In the illustrated embodiment, the back frame member 220 includes a wireform member 222 with ends 224 and 226. Similarly, the leg frame member 240 includes a wireform member 242 with ends 244 and 246. The particular size and shape of the wireform members 222 and 242 may be varied depending on desired contour and size of the surface on which an infant is to be supported. In an alternative embodiment, the back and leg frame members 240 and 220 may include tubes instead of wireform members 222 and 242.

As illustrated in FIG. 2, the seat frame 104 includes several sleeves that are used to couple the movable components of the seat frame 104 together. In particular, the seat frame 104 includes sleeves 122 and 142 that couple the leg frame member 240 to connectors 150 and 180, respectively. The seat frame 104 also includes sleeves 210 and 216 that couple the back frame member 220 to side connectors 150 and 180, respectively.

Sleeve 122 includes a shaft portion 124 and a mounting portion 126. The mounting portion 126 is positioned in recess 160 on the side connector 150 and is pivotally coupled to the side connector 150. End 244 of leg frame member 240 is received in an opening in the shaft portion 124. The end 244 and the shaft portion 124 are fixedly coupled together using a conventional fastener (not shown).

Sleeve 142 includes a shaft portion 144 and a mounting portion 146. The mounting portion 146 is positioned in a corresponding recess on the side connector 180 and is pivotally coupled to the side connector 180. End 246 of leg frame member 240 is inserted into an opening in the shaft portion 144. The end 246 and the shaft portion 144 are fixedly coupled together using a conventional fastener (not shown).

Sleeve 210 includes a shaft portion 211 and a mounting portion 212. The mounting portion 212 is positioned in recess 162 on the side connector 150 and is pivotally coupled to the side connector 150. End 224 of back frame member 220 is inserted into an opening in the shaft portion 211. The end 224 and the shaft portion 211 are fixedly coupled together using a conventional fastener (not shown).

Sleeve 216 includes a shaft portion 217 and a mounting portion 218. The mounting portion 218 is positioned in a corresponding recess on the side connector 180 and is pivotally coupled to the side connector 180. End 226 of back frame member 220 is inserted into an opening in the shaft portion 217. The end 226 and the shaft portion 217 are fixedly coupled together using a conventional fastener (not shown).

As illustrated in FIG. 2, side connector 150 includes recesses 160, 162, and 170 to receive sleeves 122 and 210 and lower end 114 of hanger arm 110. The particular structure of the side connector 150 is discussed in more detail with respect to FIGS. 12 and 13. The structure of side connector 180 is a mirror-image of that of side connector 150.

In an alternative embodiment, the back frame member 220 and the leg frame member 240 are coupled to the connectors 150 and 180 without any sleeves. In this embodiment, the ends of the back frame member 220 and the leg frame member 240 are directly coupled to the side connectors 150 and 180. Each end 244 and 246 of leg frame member 240 includes an opening through which a conventional fastener, such as a rivet or bolt, may be inserted to couple the ends 244 and 246 to the side connectors 150 and 180, respectively. Similarly, each end 224 and 226 of the back frame member 220 includes an opening through which a conventional fastener may be inserted to couple the ends 224 and 226 to the side connectors 224 and 226, respectively.

Referring to FIGS. 3–7, the relative movements of the swing components and the various configurations of the swing are described. As illustrated in the side view of the swing in FIG. 3, the swing 10 has a deployed or operative configuration 12 in which the swing 10 can support an infant.

In this swing deployed configuration 12, the base frame 20 is disposed in its deployed configuration 22. As illustrated, the front frame portion 30 and the rear frame portion 40 are located in their outward or support positions relative to housings 50 and 70.

In this configuration 12, the seat frame 104 is disposed in its deployed configuration 106. The back frame member 220 is positioned in a deployed position 228 to support the back of an infant. The leg flame member 240 is positioned in a deployed position 248 to support the bottom and legs of an infant. As discussed in detail below, the deployed positions of the back and leg frame members 220 and 240 relative to a horizontal plane can vary based on the desired configuration and contour of the seat of the swing.

Figure 3:
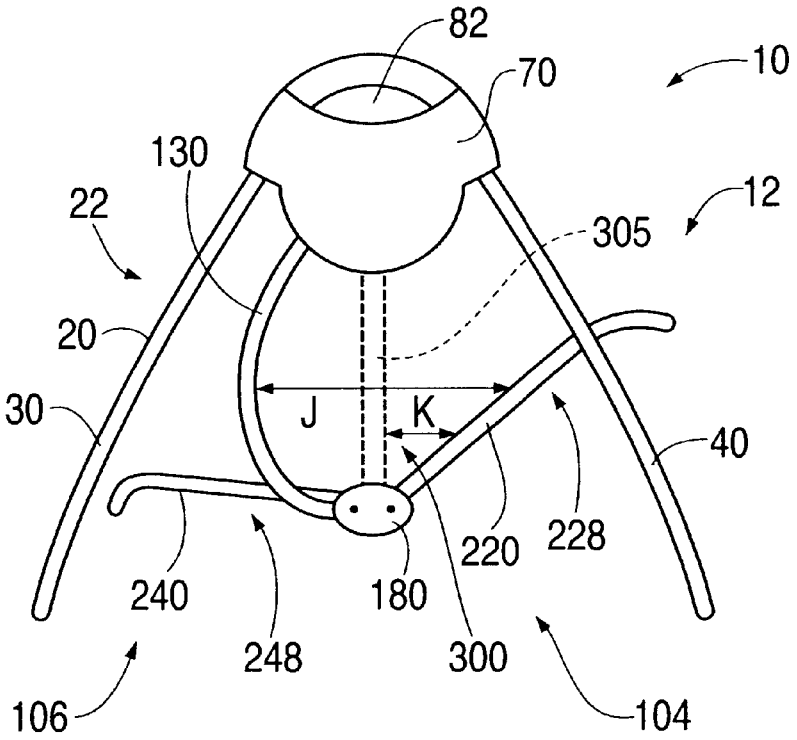
FIG. 3 illustrates a side view of the swing of FIG. 1 in a deployed configuration.

As illustrated in FIG. 3, hanger arm 130 is coupled to housing 70 and to side connector 180. As previously discussed, hanger arm 110 is coupled to housing 50 and to side connector 150.

Figure 4:
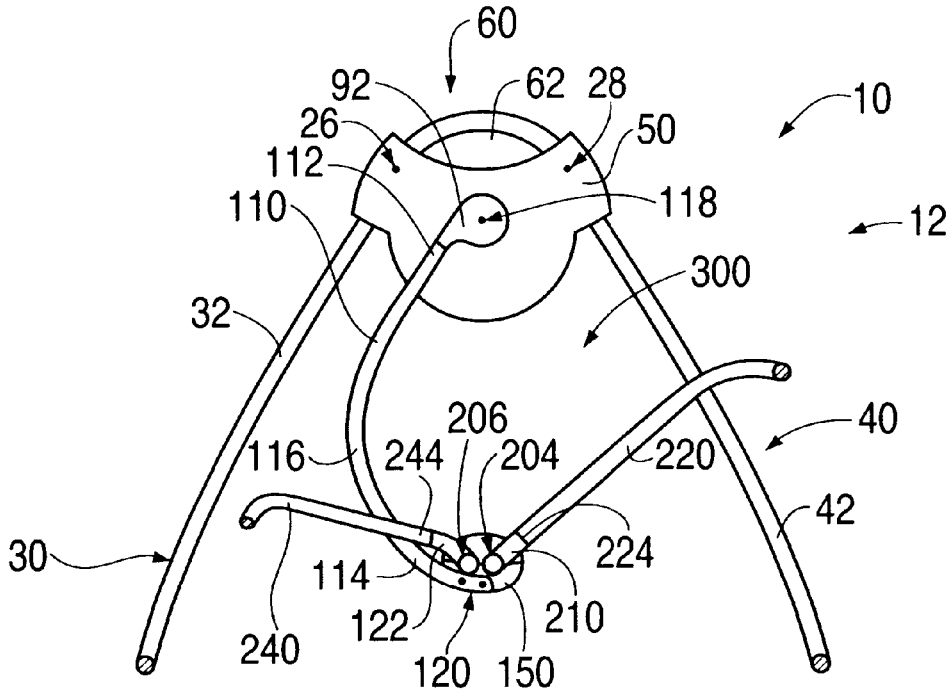
FIG. 4 illustrates a cross-sectional side view of the frame of the swing of FIG. 3 taken along a vertical plane through the midpoint or center of the swing.

Referring to FIG. 4, a cross-sectional side view of the flame of the swing of FIG. 3 is illustrated. While only the left side components of the swing are discussed relative to FIG. 4, the right side components of the swing have the correspondingly similar connections and structures and are not discussed in detail for simplicity reasons only.

Leg 32 of the front frame portion 30 is coupled to the housing 50 at pivot point 26 via any conventional fastener or connector. Similarly, leg 42 of rear frame portion 40 is coupled to housing 50 at pivot point 28. The front frame portion 30 and the rear frame portion 40 are mounted to housing 50 for rotation about pivot points 26 and 28, respectively.

Now the connections between the hanger arms and the relevant components of the swing are discussed relative to FIG. 4. The structures and connections of the hanger arms are substantially similar, and thus, only hanger arm 110 is illustrated and discussed in detail for simplicity reasons only.

In the illustrated embodiment, the hub 92 is mounted to the housing 50 for movement about a pivot point 118. The lower end 114 of the hanger arm 110 is coupled to side connector 150 at a connection or coupling point or points 120.

The hub 96 is mounted to housing 70 for reciprocating movement about a pivot point (not shown). The lower end 134 of the hanger arm 130 is also coupled to side connector 180 at a connection or coupling point (not shown).

In the illustrated embodiment, the handle portion 60 and the transport opening 62 are separate from and located above the pivot point 118. Similarly, the handle portion 80 and the transport opening 82 are separate from and located above the pivot point on housing 70 for hub 96. In alternative embodiments, the handle portions may be positioned at different locations on the housings relative to the pivot points.

In the illustrated embodiment, the body portion 116 of the hanger arm 110 extends forwardly from the pivot point 118 and the connection 120. The body portion 116 is curved so that it extends toward the front frame portion 30 and is open or concave towards the rear frame portion 40. The body portion 136 of the hanger arm 130 has a similar configuration and orientation.

Figure 5:
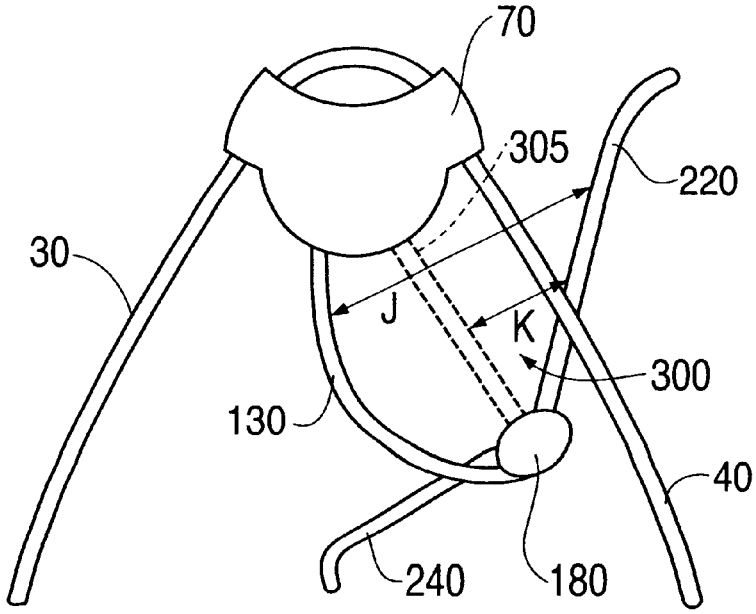
FIG. 5 illustrates a side view of the swing of FIG. 3 in an operative position.

As illustrated in FIGS. 3 and 5, the hanger arm is and the back frame member 220 are spaced apart by a distance J. In FIGS. 3 and 5, the swing of the present invention and a hanger arm 305 of a conventional swing is illustrated (in phantom). The hanger arm 305 has a straight or linear configuration. The hanger arm 305 and the rear frame portion arc spaced apart by a distance K. The hanger arms 305 and the back frame member form a region 300 in which a body part of an infant could become entrapped. If the head of an infant on the seat extends outwardly into region 300, the infant's head could become entrapped between hanger arm 305 and the back frame member 220 when the seat is in a rearward position as illustrated in FIG. 5.

The configuration and orientation of the hanger arms in the swing of the present invention increases the distance J and the region 300 between the hanger arms and the back frame member 220 relative to the corresponding distance K and region 300 in a swing of comparable size that has linear hanger arms (such as hanger arm 305 in FIGS. 3 and 5). In particular, the distance J and region 300 between the hanger arms and back frame member 220 are larger than the corresponding distance K and region 300 in a comparable swing that has linear hanger arms. The larger distance J and the larger free space region 300 reduce the likelihood that a body part of an infant located in the seat of the swing can become entrapped or pinched between either of the hanger arms and the rear of the seat frame.

In the illustrated embodiment, the leg frame member 240 and sleeve 122 are mounted to side connector 150 for movement about coupling point 206. Similarly, the back frame member 220 and sleeve 210 are mounted to side connector 150 for movement about coupling point 204.

Figure 6:
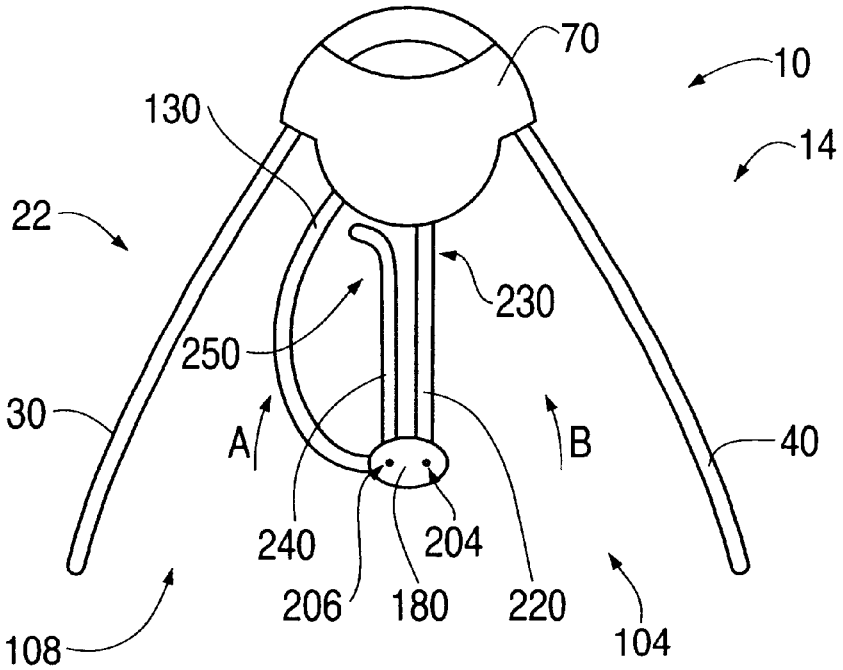
FIG. 6 illustrates a side view of the swing of FIG. 3 in a partially collapsed configuration.

Referring to FIG. 6, the swing 10 is illustrated in a partially collapsed configuration 14. In this configuration 14, the seat frame 104 of the swing 10 is disposed in a collapsed configuration 108. In this collapsed configuration 108, the leg frame member 240 is pivoted around coupling point 206 along the direction of arrow "A" to a collapsed position 250. Similarly, the back frame member 220 is pivoted around coupling point 204 along the direction of arrow "B" to a collapsed position 230.

Figure 7:
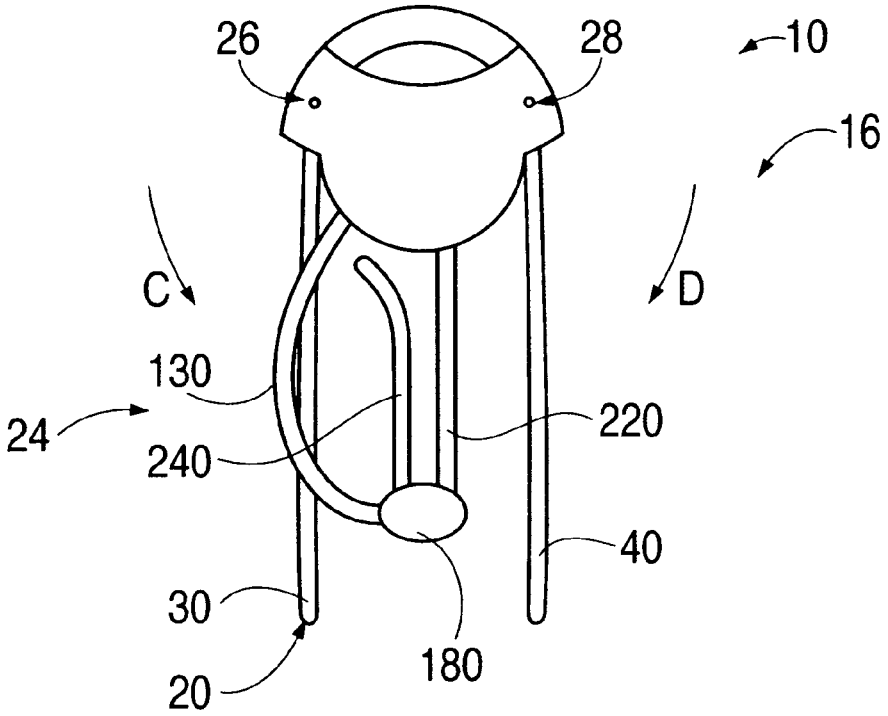
FIG. 7 illustrates a side view of the swing of FIG. 3 in a fully collapsed configuration.

Referring to FIG. 7, the swing 10 is illustrated in a fully collapsed configuration 16. In this configuration 16, the base frame 20 of the swing 10 is disposed in a collapsed configuration 24. The front frame portion 30 is pivoted around pivot point 26 along the direction of arrow "C" to a collapsed position. Similarly, the real frame portion 40 is pivoted around pivot point 28 along the direction of arrow "D" to a collapsed position.

Figure 8:
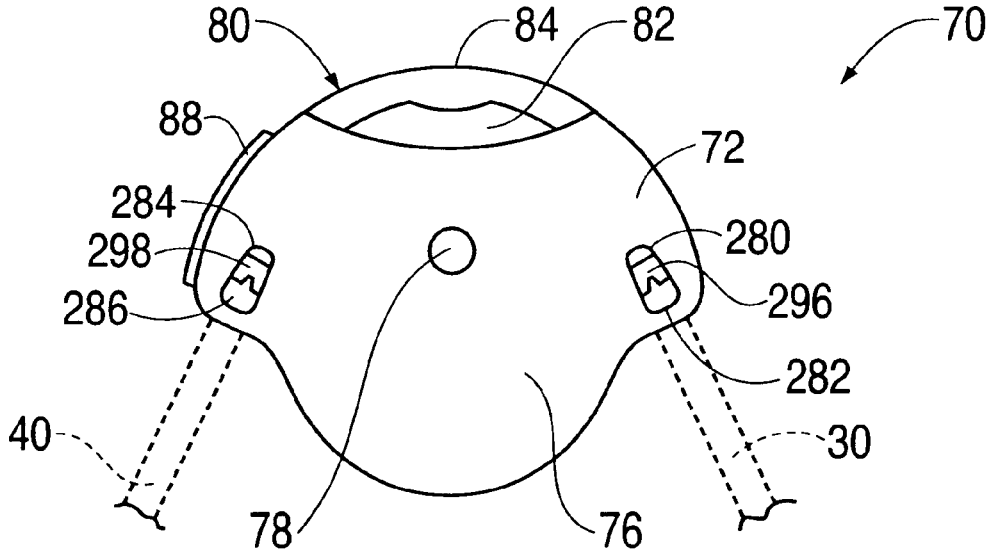
FIG. 8 illustrates a side view of a housing of the swing of FIG. 1.
Figure 9:
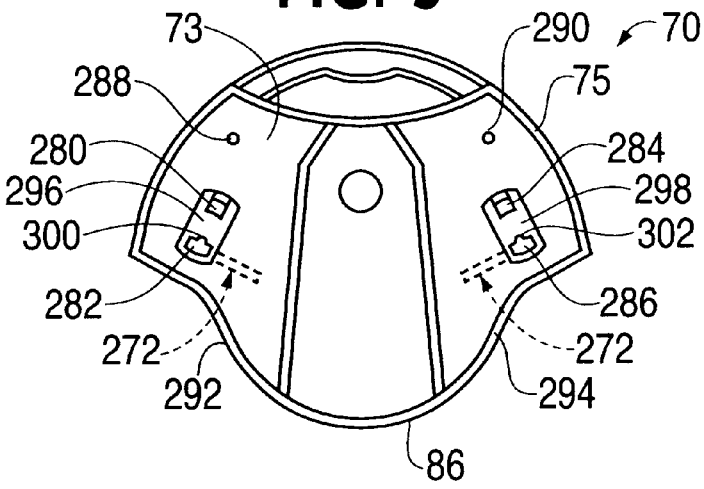
FIG. 9 illustrates a side view of the inner surface of a portion of the housing of FIG. 8.

An embodiment of a housing according to the present invention is illustrated in FIGS. 8 and 9. In the illustrated embodiment, housing 70 contains the drive mechanism for the swing 10 and can be referred to as the drive housing. Housing 50 can be referred to as an idler housing. Each of the housings includes an outer half portion and an inner half portion that are coupled together via any conventional connector. With the exception of the pivot 55 on housing 50 instead of an opening through which part of the drive mechanism can extend, housings 50 and 70 are similar in structure and function, and thus, only housing 70 is described in detail for reasons of simplicity only.

As illustrated in FIG. 8, housing 70 includes a body 76 and a handle portion 80. The handle portion 80 includes a handle 84 coupled to the body 76. The handle 84 and the body 76 define a handle or transport opening 82 therebetween. The body 76 includes an inner side 72 that faces the seat assembly and an opposite outer side 74.

The body 76 of housing 70 includes a drive or hub opening 78 through which an element of the drive mechanism extends to support the hub 96. In the illustrated embodiment, the handle 84 and the handle opening 82 are located above the drive opening 78. In alternative embodiments, the handle 84 and handle opening 82 may be positioned at any location on the housing 70.

The body 76 of the housing 70 includes two pairs of actuator openings 280 and 282, and 284 and 286. Each pair of actuator openings receives an actuator that is used to adjust the positions of the front and rear frame portions 30 and 40 (shown in phantom) relative to the housing 70.

A view of the inside surface of the inner half portion of housing 70 is illustrated in FIG. 9. Housing 70 includes an inner surface 73 with a wall 75 that extends along nearly the entire perimeter edge of the housing 70. The wall 75 includes openings 292 and 294 along the lower surface 86 of the housing 70 that allow the legs 34 and 44 of the base frame 20 to move relative to the housing 70. T he body portion 76 includes mounting openings 288 and 290 into which fasteners pivotally coupling the legs 34 and 44 to the housing 70 are inserted.

Each leg 34 and 44 includes a conventional spring-biased button inside the leg that engages with the housing 70 to retain the leg in its deployed position. When a user wants to collapse either of the front frame portion 30 or the rear frame portion 40, the user presses the button in each corresponding leg inwardly and pivots that leg relative to the housing 70.

As illustrated in FIGS. 8 and 9, the housing 70 includes plates 296 and 298 mounted to the body 76. Plate 296 and the body 76 define openings 280 and 282 and plate 296 includes a recess 300. Similarly, plate 298 and the body 76 define openings 284 and 286 and plate 298 includes a recess 302. The button in leg 32 engages recess 300 when the front frame portion 30 is in its deployed position. Similarly, the button in leg 42 engages recess 302 when the rear frame portion 40 is in its deployed position.

In the illustrated embodiment, the swing 10 includes two actuators mounted to each of the housings 50 and 70 that engage the spring-biased buttons in the corresponding legs. The particular orientation of each actuator depends on the location of the actuator on the housing.

Figure 10:
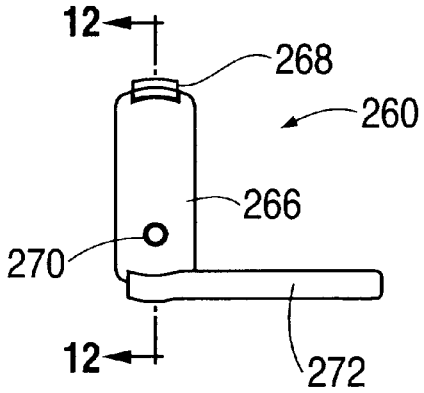
FIG. 10 illustrates a rear view of an embodiment of an actuator according to the present invention.
Figure 11:
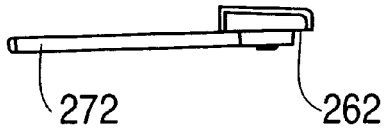
FIG. 11 illustrates a bottom view of the actuator of FIG. 10.
Figure 12:
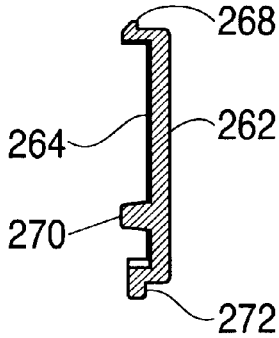
FIG. 12 illustrates a cross-sectional side view of the actuator of FIG. 10 taken along the line "12—12" in FIG. 10.

An embodiment of an actuator is illustrated in FIGS. 10–12. The actuator 260 includes a plate 266 with an outer surface 262 and an inner surface 264. The actuator 260 includes a tab 268 at one end and an arm 272 at another end. The tab 268 and arm 272 are inserted into openings 280 and 282 on housing 70 to mount the actuator 260 to the housing 70 (see FIG. 9 in which arm 272 is illustrated in dashed lines).

The actuator 260 includes a post 270 mounted on the inner surface 264 of the plate 266. When the actuator 260 is mounted on the housing 70, the post 270 engages recess 300. When a user presses on the outer surface 264 of the actuator 260, the post 270 moves the corresponding spring-biased button inwardly and out of engagement with the recess 300 and leg 32 can be moved. The relevant components and operation is the same for the connection of each leg and the corresponding housing.

Figure 13:
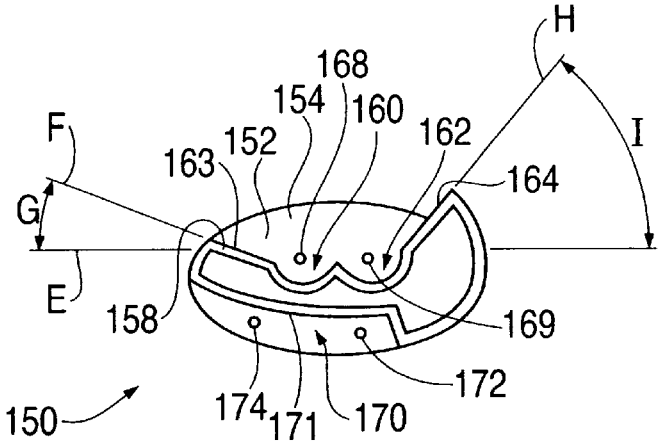
FIG. 13 illustrates a perspective view of an embodiment of a side connector according to the invention.
Figure 14:
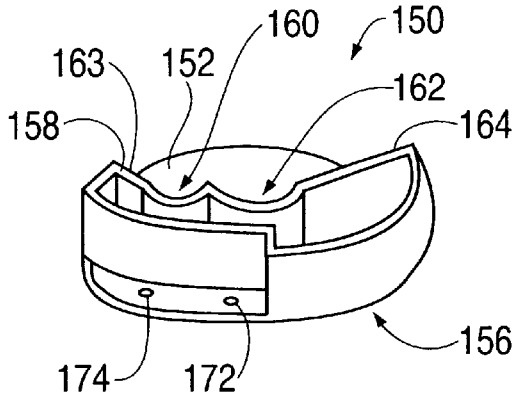
FIG. 14 illustrates a side view the side connector of FIG. 13.

An embodiment of a side connector according to the present invention is illustrated in FIGS. 13 and 14. Because side connectors 150 and 180 are similar in structure and function, only side connector 150 is described in detail for reasons of simplicity only.

Side connector 150 includes a plate 152 with an inner side 154 and an outer side 156. The plate 152 has a ridge 158 projecting from to its inner side 154. The ridge 158 has recesses 160 and 162 formed along one side. As previously discussed, sleeves 122 and 210 are mounted in recesses 160 and 162, respectively. The sleeves 122 and 210 are coupled to the side connector 150 via fasteners inserted through openings 168 and 169, respectively.

The ridge 158 also includes contact surfaces 163 and 164 that determine the orientation of sleeves 122 and 210 and the back and leg frame members 220 and 240. As illustrated in FIG. 14, contact surface 162 is disposed in a plane F that is oriented at an angle G with respect to a horizontal plane E (when the seat is in its rest position at the bottom of its travel). In the illustrated embodiment, angle G is approximately 25°.

Similarly, contact surface 164 is disposed in a plane F that is oriented at an angle I with respect to horizontal plane E. In the illustrated embodiment, angle I is approximately 50°. Angles G and I may vary depending on the desired orientation and the particular configuration of the seat.

The side connector 150 also includes a recess 170 formed by a wall 171 proximate to the lower surface of the side connector 150. The recess 170 is configured to receive the lower end 114 of hanger arm 110. Conventional connectors or fasteners (not shown) are inserted through openings 172 and 174 to couple the hanger arm 110 to the side connector 150.

Figure 15:
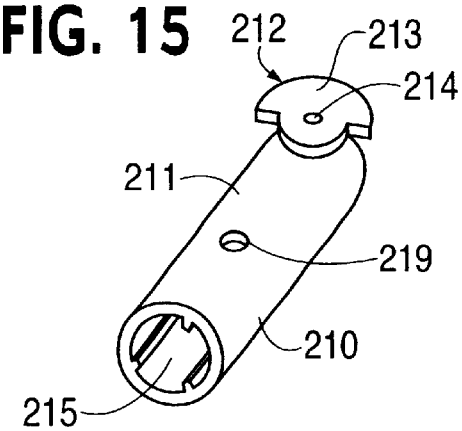
FIG. 15 illustrates a front perspective view of an embodiment of a sleeve according to the invention.
Figure 16:
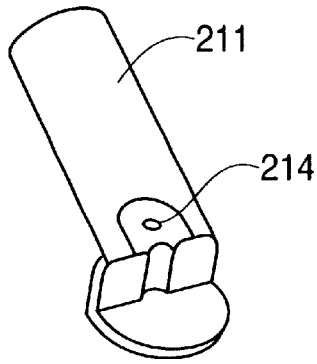
FIG. 16 illustrates a rear perspective view of the sleeve of FIG. 15.

An embodiment of a sleeve according to the present invention is illustrated in FIGS. 15 and 16. Because sleeves 122, 142, 210, and 216 are similar in structure and function, only sleeve 210 is described in detail for reasons of simplicity only.

Sleeve 210 includes a shaft portion 211 and a mounting portion 212. The shaft portion 211 includes an internal cavity 215 into which end 224 of the back frame member 220 is inserted. The shaft portion 211 also includes an opening 219 through which a fastener can be inserted to couple the sleeve 210 and the back frame member 220. The mounting portion 212 includes a plate 213 with an opening 214. A fastener (not shown) is inserted through opening 214 and through opening 169 to mount the sleeve 210 to the side connector 150.

While the side connectors, housings, and hubs of the swing are made from plastic, any suitable material may be used. While the hanger arms, the front and rear frame members of the base frame, and legs of the seat frame are metal tubes, any suitable material that provides sufficient rigidity may be used. For example, metal wire frames may be used instead of metal tubes.

In alternative embodiments, the sleeves and the side connectors may have different configurations so long as the relevant components of the swing can be mounted for movement relative to each other.

In an alternative embodiment, the swing may include a single housing and a single hanger arm coupled to the housing. The seat assembly is coupled to the single hanger arm.

In an alternative embodiment, the hanger arms of the swing can have any non-linear shape or configuration that provides more distance between the hanger arms and the back frame member than in a swing with linear hanger arms.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. A swing comprising:

a base frame, said base frame including a front frame portion, a rear frame portion, a first housing coupled to a first side of each of said front frame portion and said rear frame portion, and a second housing coupled to a second side of each of said front frame portion and said rear frame portion; and a seat frame, said seat frame including:

a seat;

a first support arm having a first end and a second end, said first end of said first support arm being pivotally coupled to said first housing at a first pivot point, said second end of said first support arm being coupled to said seat, said first end and said second end of said first support arm extending towards said rear frame portion;

a second support arm having a first end and a second end, said first end of said first support arm being pivotally coupled to said second housing at a second pivot point, said second end of said second support arm being coupled to said seat, said first end and said second end of said second support arm extending towards said rear frame portion.

2. The swing of claim 1, said first support arm including a curved body portion extending between said first and second ends of said first support arm, said second cud of said first support arm being coupled to said seat at a first connection point, said curved body portion being disposed forwardly of said first pivot point and said first connection point.

3. The swing of claim 2, said second support arm including a curved body portion extending between said first and second ends of said second support arm, said second end of said second support arm being coupled to said seat at a second connection point, said curved body portion being disposed forwardly of said second pivot point and said second connection point.

4. The swing of claim 1, said first housing including a handle portion.

5. The swing of claim 1, further comprising:

a hub, said hub being pivotally coupled to said first housing proximate to said first pivot point and being coupled to said first support arm, said first housing defining a handle opening located above said first pivot point.

6. The swing of claim 1, said first housing of said base frame including a handle.

7. The swing of claim 1, said seat frame including a first side connector, a second side connector, a back frame member pivotally coupled to said first side connector and to said second side connector, and a leg frame member pivotally coupled to said first side connector and to said second side connector.

8. The swing of claim 7, further comprising:

a fabric member, said fabric member being removably disposable on said back frame member and said leg frame member.

9. The swing of claim 7, said back frame member being pivotable between a collapsed position and a deployed position, and said leg frame member being pivotable between its own collapsed position and its own deployed position.

10. The swing of claim 1, said base frame being selectively disposable in a collapsed configuration and in a deployed configuration, and said seat frame being selectively disposable in its own collapsed configuration and in its own deployed configuration.

11. A swing comprising:

a frame, said frame including a housing, said housing including a handle extending therefrom, a front frame portion coupled to said housing, and a rear portion coupled to said housing; and a seat assembly, said seat assembly being supported by said housing of said frame, said seat assembly including a seat and a hanger arm, said hanger arm being pivotally coupled to said housing proximate to a pivot point and being concave towards said rear frame portion, said seat being supported by said hanger arm, said handle being spaced apart from and located above said pivot point, said handle facilitating transportation of the swing.

12. The swing of claim 11, said hanger arm having a non-linear configuration.

13. The swing of claim 11, said housing being a first housing, said pivot point being a first pivot point, and said hanger arm being a first hanger arm, said frame including a second housing, said second housing including its own handle, said seat assembly including a second hanger arm pivotally coupled to said second housing proximate to a second pivot point, said handle of said second housing being spaced apart from and located above said second pivot point.

14. The swing of claim 13, said frame including a front frame portion coupled to said housing and a rear frame portion coupled to said housing, said first hanger arm being concave towards said frame portion, and said second hanger arm being concave towards said rear frame portion.

15. A The swing of claim 13, said seat being coupled to said first hanger arm at a first connection point, said first hanger arm including a body portion with a non-linear configuration, said first body portion extending forwardly between said first pivot point and said first connection point, said seat being coupled to said second hanger arm at a second connection point, said second hanger arm including a body portion with a non-linear configuration, said second body portion extending forwardly between said second pivot point and said second connection point.

16. The swing of claim 11, said seat being coupled to said hanger arm at a connection point, said hanger arm including a body portion with a non-linear configuration, said body portion extending forwardly between said pivot point and said connection point.

17. A swing comprising:

a frame, said frame including a front frame portion and a rear frame portion;

a first arm, said first arm being pivotally coupled to said frame at a first pivot point;

a second arm, said second arm pivotally coupled to said frame at a second pivot point; and a seat, said seat being coupled to said first arm at a first coupling point, said seat being coupled to said second arm at a second coupling point, said first arm extending forwardly toward said front frame portion between said first coupling point and said first pivot point, said second arm extending forwardly toward said front frame portion between said second coupling point and said second pivot point.

18. The swing of claim 17, each of said first and second arms having a non-linear configuration.

19. The swing of claim 18, said seat being selectively disposable in a collapsed configuration and in a deployed configuration.

20. The swing of claim 19, said seat including a first connector, a second connector, an upper frame member pivotally coupled to said first connector and to said second connector, and a lower frame member pivotally coupled to said first connector and to said second connector, said upper frame member being selectively disposable in a collapsed position corresponding to said collapsed configuration and in a deployed position corresponding to said deployed configuration.

21. The swing of claim 17, said frame including a first housing coupled to said front frame portion and to said rear frame portion and a second housing coupled to said front frame portion and to said rear frame portion, said first housing including a handle extending therefrom, said second housing including a handle extending therefrom.

22. The swing of claim 21, said first housing handle being located above said first pivot point, said second housing handle being located above said second pivot point.

23. A seat assembly for a swing including a frame, the seat assembly comprising:

a seat frame, said seat frame having a front portion and a rear portion;

a first arm having a first end and a second end, said first arm being coupleable to said seat frame, said first arm having a non-linear configuration and said first end and said second end point towards said rear portion of said seat frame; and a second arm having a first end and a second end, said second arm being coupleable to said seat frame, said second arm having a non-linear configuration and said first end and said second end point towards said rear portion of said seat frame.

24. The seat assembly of claim 23, said seat frame including a connector, said first arm having a body portion and a lower end, said lower end being coupled to said connector, said body portion extending forwardly from said connector.

25. The seat assembly of claim 23, said first arm having a body portion with a curved configuration, said second arm having a body portion with a curved configuration.

26. The seat assembly of claim 23, said seat frame including a first connector, a second connector, an upper frame member pivotally coupled to said first connector and to said second connector, and a lower frame member pivotally coupled to said first connector and to said second connector.

27. A seat assembly for a swing including a frame, the seat assembly comprising:

a seat frame, said seat frame having a front portion, a rear portion, a first connector and a second connector, an upper frame member pivotally coupled to said first connector and to said second connector, and a lower frame member pivotally coupled to said first connector and to said second connector;

a first arm, said first arm being coupleable to said seat frame, said first arm having a non-linear configuration; and a second arm, said second and being coupleable to said seat fame, said second arm having a non-linear configuration.

* * * * *

UNITED STATES PATENT AND TRADEMARK OFFICE

CERTIFICATE OF CORRECTION

PATENT NO. : 6,702,685 B2
APPLICATION NO. : 10/133630
DATED : March 9, 2004
INVENTOR(S) : Curt J. Mahlstedt and Robert J. Sonner It is certified that error appears in the above-identified patent and that said Letters Patent is hereby corrected as shown below:

Column 5, line 15, replace “flame” with --frame--.
Column 5, line 26, replace “flame” with --frame--.
Column 6, line 1, replace “arm is” with --arm--.
Column 6, line 7, replace “arc” with --are--.
Column 6, line 47, replace “real” with --rear--.
Column 7, line 19, replace “T he” with --The--.
Column 8, line 15, replace “plane F” with --plane H--.
Column 9, line 30 (claim 2), replace “cud” with --end--.
Column 12, line 26 (claim 27), replace “and” with --arm--.
Column 12, line 27 (claim 27), replace “fame” with --frame--.

Signed and Sealed this

Twentieth Day of January, 2009

JON W. DUDAS
*Director of the United States Patent and Trademark Office*